US010017871B2

(12) United States Patent
Kuribayashi et al.

(10) Patent No.: US 10,017,871 B2
(45) Date of Patent: Jul. 10, 2018

(54) ELECTRODEPOSITING APPARATUS AND PREPARATION OF RARE EARTH PERMANENT MAGNET

(71) Applicant: SHIN-ETSU CHEMICAL CO., LTD., Tokyo (JP)

(72) Inventors: Yukihiro Kuribayashi, Echizen (JP); Yoshifumi Nagasaki, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 0 days.

(21) Appl. No.: 14/625,277

(22) Filed: Feb. 18, 2015

(65) Prior Publication Data

US 2015/0233007 A1 Aug. 20, 2015

(30) Foreign Application Priority Data

Feb. 19, 2014 (JP) ..... 2014-029677

(51) Int. Cl.
*C25D 17/00* (2006.01)
*C25D 7/00* (2006.01)
(Continued)

(52) U.S. Cl.
CPC ..... *C25D 7/001* (2013.01); *C25D 17/00* (2013.01); *C25D 17/02* (2013.01); *C25D 17/06* (2013.01); *C25D 17/12* (2013.01); *C25D 21/12* (2013.01)

(58) Field of Classification Search
CPC ..... C25D 17/12
See application file for complete search history.

(56) References Cited

U.S. PATENT DOCUMENTS 4,210,507 A * 7/1980 Davidson ..... C25D 13/14 118/308
4,280,881 A 7/1981 Montagna et al.
(Continued)

FOREIGN PATENT DOCUMENTS

CN 1898757 A 1/2007
CN 102103916 A 6/2011
(Continued)

OTHER PUBLICATIONS

Soderznik, M., et al., "The grain-boundary diffusion process in Nd—Fe—B sintered magnets based on the electrophoretic deposition of DyF3", Intermetallics, 23, 2012, p. 158-162.*
(Continued)

*Primary Examiner* — Stefanie S Wittenberg
(74) *Attorney, Agent, or Firm* — Westerman, Hattori, Daniels & Adrian, LLP

(57) ABSTRACT

An electrodepositing apparatus is provided comprising an inner tank (1) filled with an electrodepositing solution, an outer tank (3), a feedback means (4), a rectifying member (5) disposed in the inner tank (1), a means (8) for holding an article (p), a counter electrode (6), and a power supply (9). The electrodepositing solution is circulated in such a way that it overflows the inner tank and is fed back from the outer tank to the inner tank by the feedback means, the flow of the solution is rectified by the rectifying member to keep flat the solution surface in the inner tank, a selected portion of the article is immersed in the solution, and the coating agent is electrodeposited on the selected portion of the article.

6 Claims, 4 Drawing Sheets

(51) Int. Cl.

| | |
|---|---|
| ***C25D 17/02*** | (2006.01) |
| ***C25D 17/06*** | (2006.01) |
| ***C25D 17/12*** | (2006.01) |
| ***C25D 21/12*** | (2006.01) |

(56) References Cited

U.S. PATENT DOCUMENTS

| | | | | |
|---|---|---|---|---|
| 4,959,273 | A | 9/1990 | Hamamura et al. | |
| 5,034,146 | A | 7/1991 | Ohashi et al. | |
| 6,261,426 | B1 * | 7/2001 | Uzoh | C25D 5/08 204/224 R |
| 7,559,996 | B2 | 7/2009 | Miyata et al. | |
| 2003/0127337 | A1 * | 7/2003 | Hanson | H01L 21/67103 205/96 |
| 2006/0000704 | A1 * | 1/2006 | Sato | C25D 17/001 204/192.1 |
| 2006/0108226 | A1 | 5/2006 | Wolz | |
| 2007/0017601 | A1 | 1/2007 | Miyata et al. | |
| 2007/0175759 | A1 * | 8/2007 | Klocke | C25D 7/12 204/471 |
| 2008/0035475 | A1 * | 2/2008 | Gebhart | C25D 5/08 204/273 |
| 2008/0245442 | A1 | 10/2008 | Nakamura et al. | |
| 2009/0098006 | A1 | 4/2009 | Nakamura et al. | |
| 2009/0134034 | A1 * | 5/2009 | Pass | C25D 17/001 205/136 |
| 2009/0297699 | A1 | 12/2009 | Baba et al. | |
| 2011/0150691 | A1 | 6/2011 | Nakamura et al. | |
| 2011/0168558 | A1 | 7/2011 | Fransaer et al. | |
| 2012/0139388 | A1 | 6/2012 | Iwasaki et al. | |
| 2013/0092867 | A1 | 4/2013 | Shoji et al. | |
| 2015/0206653 | A1 | 7/2015 | Nagasaki et al. | |
| 2015/0211138 | A1 | 7/2015 | Nagasaki et al. | |
| 2015/0211139 | A1 | 7/2015 | Nagasaki et al. | |
| 2015/0233006 | A1 | 8/2015 | Kuribayashi et al. | |
| 2015/0233007 | A1 | 8/2015 | Kuribayashi et al. | |

FOREIGN PATENT DOCUMENTS

| | | | |
|---|---|---|---|
| CN | 102693828 | A | 9/2012 |
| EP | 2 892 064 | A1 | 7/2015 |
| EP | 2 894 645 | A1 | 7/2015 |
| JP | 02-083905 | A | 3/1990 |
| JP | 05-021218 | A | 1/1993 |
| JP | 05-031807 | B2 | 5/1993 |
| JP | H10-311913 | A | 11/1998 |
| JP | 2000-58731 | A | 2/2000 |
| JP | 2005-29864 | A | 2/2005 |
| JP | 2006-517004 | A | 7/2006 |
| JP | 2006303434 | A | 11/2006 |
| JP | 2007-53351 | A | 3/2007 |
| JP | 2007-288020 | A | 11/2007 |
| JP | 2007-288021 | A | 11/2007 |
| JP | 2007-305818 | A | 11/2007 |
| JP | 2007-313403 | A | 12/2007 |
| JP | 2008-061333 | A | 3/2008 |
| JP | 2009-165349 | A | 7/2009 |
| JP | 2010-135529 | A | 6/2010 |
| JP | 2011-051851 | A | 3/2011 |
| JP | 2011-114149 | A | 6/2011 |
| JP | 2011-219844 | A | 11/2011 |
| JP | 2012-169436 | A | 9/2012 |
| JP | 2012-522126 | A | 9/2012 |
| JP | 2013-106494 | A | 5/2013 |
| KR | 10-2012-0006518 | A | 1/2012 |
| WO | 2004/020704 | A1 | 3/2004 |
| WO | 2006/043348 | A1 | 4/2006 |
| WO | 2011/108704 | A1 | 9/2011 |

OTHER PUBLICATIONS

Partial European Search Report dated Aug. 3, 2015, issued in counterpart European Application No. 15155339.3 (5 pages).

Office Action dated Dec. 20, 2016, issued in counterpart Japanese Application No. 2014-029677. (4 pages).

Soderznik et al., "The grain-boundary diffusion process in Nd—Fe—B sintered magnets based on the electrophorectic deposition of DyF3", Intermetallics, vol. 23, Dec. 27, 2012, pp. 158-162. (5 pages). Cited in EESR dated Aug. 3, 2015.

Suppan et al., "Electroplating dysprosium from IL-Based Solutions: A Promising Electrochemical Step to Produce Stronger High Performance Nd(Dy)—Fe—B Sintered Magnets", Journal of the Electrochemical Society, vol. 162, No. 8, Jan. 1, 2015 (7 pages). Cited in EESR dated Aug. 3, 2015.

International Search Report dated Oct. 8, 2013, issued in counterpart International Application No. PCT/JP2013/073327. (2 pages).

Extended (Supplementary) European Search Report dated May 4, 2016, issued in counterpart European Patent Application No. 13832562.6 (6 pages).

Office Action dated Jul. 5, 2016, issued in counterpart Japanese Patent Application No. 2013-179444, with English translation. (6 pages).

International Search Report dated Oct. 8, 2013, issued in International Application No. PCT/JP2013/073333. (2 pages).

Office Action dated Jul. 5, 2016, issued in counterpart Japanese Patent Application No. 2013-179527, with English translation. (6 pages).

Extended (supplementary) European Search Report dated Mar. 22, 2016, issued in counterpart European Patent Application No. 13832698.8. (9 pages).

International Search Report dated Oct. 8, 2013, issued in counterpart International Application No. PCT/JP2013/073324. (2 pages).

Office Action dated May 11, 2016, issued in counterpart Chinese Patent Application No. 201380044779.0, with English translation. (16 pages).

Office Action dated Jun. 7, 2016, issued in counterpart Japanese Patent Application No. 2013-179407, with English translation. (6 pages).

Extended (supplementary) European Search Report dated Mar. 22, 2016, issued in counterpart European Patent Application No. 13832170.8. (10 pages).

Nakamura, H., et al., "Coercivity Distributions in Nd—Fe—B Sintered Magnets Produced by the Grain Boundary Diffusion Process", Journal of Physics D: Applied Physics, 2011, 44, 064003, pp. 1-5.

Q. Li et al., "Electroplating of anticorrosive Ni—Ti02 composite coatings on sintered NdFeB permanent magnets", Transactions of the Institute of Metal Finishing, Maney Publishing, Birmingham, GB, vol. 87, No. 3, May 1, 2009, pp. 149-154.

Non-Final Office Action dated Mar. 9, 2017, issued in U.S. Appl. No. 14/424,647 (33 pages).

Non-Final Office Action dated Mar. 10, 2017, issued in U.S. Appl. No. 14/424,707 (37 pages).

Non-Final Office Action dated Mar. 14, 2017, issued in U.S. Appl. No. 14/424,735 (30 pages).

Machida, et al., "Grain Boundary Modification and Magnetic Properties of Nd—Fe—B Sintered Magnets", Abstract of Spring Meeting of Japan Society of Powder & Powder Metallurgy, 2004, p. 202, w/English translation.

Park, et al., "Effect of Metal-Coating and Consecutive Heat Treatment on Corecivity of Thin Nd—Fe—B Sintered Magnets", Proceedings of the Sixteenth International Workshop on Rare-Earth Magnets and Their Applications, 2000, p. 257-264.

Novak, et al., "Fabrication of alumina parts by electrophoretic deposition from ethanol and aqueous suspensions", Ceramics International, 35, 2009, pp. 2823-2829.

Extended European Search Report dated Aug. 3, 2015, issued in counterpart Application No. 15155176.9. (7 pages).

Durst, et al., "The Coercive Field of Sintered and Melt-Spun NdFeB Magnets", Journal of Magnetism and Magnetic Materials, North-Holland,1987, vol. 68, pp. 63-75.

Non-Final Office Action dated Dec. 9, 2015, issued in U.S. Appl. No. 14/624,779 (30 pages).

Final Office Action dated Jun. 17, 2016, issued in U.S. Appl. No. 14/624,779 (22 pages).

(56) References Cited

OTHER PUBLICATIONS

Non-Final Office Action dated Dec. 21, 2016, issued in U.S. Appl. No. 14/624,779 (26 pages).
Final Office Action dated Apr. 13, 2017, issued in U.S. Appl. No. 14/624,779 (14 pages).
Moreno R. et al., Effect of the slurry properties on the homogeneity of alumina deposits obtained by aqueous electrophoretic deposition, Materials Research Bulletin 35 (2000), accepted Aug. 12, 1999, pp. 887-897. (11 pages).
Final Office Action dated Aug. 11, 2017, issued in U.S. Appl. No. 14/424,707 (17 pages).
Chinese Office Action dated Jun. 27, 2017, issued in counterpart Chinese Patent Application No. 201510085234.5 with English translation.

* cited by examiner

ELECTRODEPOSITING APPARATUS AND PREPARATION OF RARE EARTH PERMANENT MAGNET

CROSS-REFERENCE TO RELATED APPLICATION

This non-provisional application claims priority under 35 U.S.C. § 119(a) on Patent Application No. 2014-029677 filed in Japan on Feb. 19, 2014, the entire contents of which are hereby incorporated by reference.

TECHNICAL FIELD

This invention relates to an electrodepositing apparatus wherein an article is coated by immersing a selected portion of the article in an electrodepositing solution having a coating agent dispersed or dissolved in a solvent, and applying a voltage between the article and a counter electrode for letting the coating agent deposit on the selected portion of the article, and a method for preparing a rare earth permanent magnet using the apparatus.

BACKGROUND ART

By virtue of excellent magnetic properties, Nd—Fe—B base permanent magnets find an ever increasing range of application. In the field of rotary machines such as motors and power generators, permanent magnet rotary machines using Nd—Fe—B base permanent magnets have recently been developed in response to the demands for weight and profile reduction, performance improvement, and energy saving. The permanent magnets within the rotary machine are exposed to elevated temperature due to the heat generation of windings and iron cores and kept susceptible to demagnetization by a diamagnetic field from the windings. There thus exists a need for a sintered Nd—Fe—B base magnet having heat resistance, a certain level of coercive force serving as an index of demagnetization resistance, and a maximum remanence serving as an index of magnitude of magnetic force.

An increase in the remanence (or residual magnetic flux density) of sintered Nd—Fe—B base magnets can be achieved by increasing the volume factor of $Nd_2Fe_{14}B$ compound and improving the crystal orientation. To this end, a number of modifications have been made on the process. For increasing coercive force, there are known different approaches including grain refinement, the use of alloy compositions with greater Nd contents, and the addition of effective elements. The currently most common approach is to use alloy compositions in which Dy or Tb substitutes for part of Nd. Substituting these elements for Nd in the $Nd_2Fe_{14}B$ compound increases both the anisotropic magnetic field and the coercive force of the compound. The substitution with Dy or Tb, on the other hand, reduces the saturation magnetic polarization of the compound. Therefore, as long as the above approach is taken to increase coercive force, a loss of remanence is unavoidable.

The method capable of meeting both remanence and coercivity is proposed in Patent Documents 1 and 2. A sintered magnet body of $R^1$—Fe—B base composition wherein $R^1$ is at least one element selected from rare earth elements inclusive of Y and Sc is coated on its surface with a powder containing an oxide, fluoride or oxyfluoride of $R^2$ wherein $R^2$ is at least one element selected from rare earth elements inclusive of Y and Sc. The coated magnet body is heat treated whereby $R^2$ is absorbed in the magnet body.

This method is successful in increasing coercive force while significantly suppressing a decline of remanence. Still some problems must be overcome before the method can be implemented in practice. Means of providing a powder on the surface of a sintered magnet body is by immersing the magnet body in a dispersion of the powder in water or organic solvent, or spraying the dispersion to the magnet body, both followed by drying. The immersion and spraying methods are difficult to control the coating weight (or coverage) of powder. A short coverage fails in sufficient absorption of $R^2$. Inversely, if an extra amount of powder is coated, precious $R^2$ is consumed in vain. Also since such a powder coating largely varies in thickness and is not so high in density, an excessive coating weight is necessary in order to enhance the coercive force to the saturation level. Furthermore, since a powder coating is not so adherent, problems are left including poor working efficiency of the process from the coating step to the heat treatment step and difficult treatment over a large surface area.

As the method of efficiently and tightly depositing a powder of $R^2$ onto the surface of a sintered magnet body, one effective method contemplated is by immersing the magnet body in an electrodepositing solution having the $R^2$ powder dispersed therein, and causing the $R^2$ powder to deposit on the magnet body via electrodeposition. The electrodeposition process enables to control the coating weight of the powder and to form a uniform powder coating having tight adhesion. However, since rare earth elements as typified by Dy and Tb are rare and very expensive, there is still a need for efficient and economical means of coating a rare earth magnet body with a rare earth-containing powder.

CITATION LIST

Patent Document 1: JP-A 2007-053351
Patent Document 2: WO 2006/043348

SUMMARY OF INVENTION

In conjunction with a method for preparing a rare earth permanent magnet by coating the surface of a sintered magnet body having a $R^1$—Fe—B base composition (wherein $R^1$ is at least one element selected from rare earth elements inclusive of Y and Sc) with a powder containing an oxide of $R^2$ (wherein $R^2$ is at least one element selected from rare earth elements inclusive of Y and Sc) or the like and heat treating the coated magnet body, an object of the invention is to provide an electrodepositing apparatus which is used in the step of coating the magnet body surface with the powder so as to enable efficient and economical electrodeposition of the powder and to form a uniform dense coating of the powder on the magnet body surface without powder waste, thereby enabling to prepare a high-performance rare earth magnet having a satisfactory remanence and high coercive force in an efficient and economical manner.

Claim 1:

An electrodepositing apparatus wherein an article is coated by immersing the article in an electrodepositing solution having a coating agent dispersed or dissolved in a solvent, and applying a voltage between the article and a counter electrode opposed to the article for letting the coating agent deposit on the surface of the article, said apparatus comprising an inner tank filled with the electrodepositing solution and adapted to effect electrodeposition on the article immersed in the solution, an outer tank enclosing the inner tank so that the outer tank may receive an overflow of the electrodepositing solution from the inner tank, a feedback means for feeding the electrodepositing solution from the outer tank back to the inner tank near its bottom, a rectifying member disposed in the inner tank for suppressing waving of the surface of the electrodepositing solution overflowing from the upper rim of the inner tank, a means for holding the article so that the article may be partially immersed in the electrodepositing solution in the inner tank, a counter electrode disposed in the inner tank and opposed to the article which is held by the holding means and immersed in the solution, and a power supply for applying a predetermined voltage between the article and the counter electrode, wherein the electrodepositing solution is circulated in such a way that it overflows the inner tank into the outer tank and is fed back from the outer tank to the inner tank near its bottom by the feedback means, a selected portion of the article held by the holding means is immersed in the electrodepositing solution in the inner tank, and the power supply is actuated to apply the predetermined voltage between the article and the counter electrode for a predetermined time, whereby the coating agent is electrodeposited on the article surface to form a coating on the selected portion of the article surface.

Claim 2:

The apparatus of Claim 1 wherein the inner tank includes a peripheral wall which is provided at its upper rim with a plurality of equally spaced apart V-shaped notches across which the electrodepositing solution overflows.

Claim 3:

The apparatus of Claim 1 or 2 wherein the inner tank includes a bottom wall, a return pipe having a plurality of orifices in its tubular wall is connected to the feedback means and extended through the inner tank along the bottom wall, and the feedback means feeds the electrodepositing solution into the return pipe to inject the solution into the inner tank through the orifices.

Claim 4:

The apparatus of Claim 3 wherein the orifices are arranged in the return pipe such that their diameter may gradually or stepwise decrease from the proximal end connected to the feedback means to the distal end of the return pipe.

Claim 5:

The apparatus of any one of Claims 1 to 4 wherein the rectifying member is a rectifier plate having a plurality of apertures, the rectifier plate is disposed at a vertical intermediate position in the inner tank and horizontally extended so as to divide the inner tank into upper and lower compartments.

Claim 6:

The apparatus of Claim 5 wherein the apertures are arranged in the rectifier plate such that the diameter of apertures near the periphery is smaller than the diameter of apertures near the center of the plate.

Claim 7:

The apparatus of Claim 5 or 6 wherein the counter electrode is a metal plate having a plurality of apertures and disposed on the rectifier plate.

Claim 8:

The apparatus of Claim 7 wherein the counter electrode is a metal disk having a plurality of apertures, the disk being generally frusto-conical shaped at a central portion or over its entirety.

Claim 9:

The apparatus of any one of Claims 1 to 8, further comprising a means for monitoring the state of the electrodepositing solution, said monitoring means being at least one of a level meter, thermometer, concentration meter, and flow meter.

Claim 10:

A method for preparing a rare earth permanent magnet, comprising the steps of coating a sintered magnet body having a $R^1$—Fe—B base composition wherein $R^1$ is at least one element selected from rare earth elements inclusive of Y and Sc with a powder comprising at least one member selected from the group consisting of an oxide, fluoride, oxyfluoride, hydride, and rare earth alloy of $R^2$ wherein $R^2$ is at least one element selected from rare earth elements inclusive of Y and Sc, and heat treating the coated magnet body for causing $R^2$ to be absorbed in the magnet body, the coating step including the steps of using the electrodepositing apparatus of any one of Claims 1 to 9, immersing a selected portion of the magnet body in an electrodepositing solution of the powder dispersed in a solvent, and electrodepositing the powder on the surface of the magnet body to form a powder coating on the selected portion of the magnet body, prior to the heat treating step.

The electrodepositing apparatus as set forth in Claim 1 is operated as follows. A selected portion of the article held by the holding means is immersed in the electrodepositing solution in the inner tank. The power supply is actuated to apply the predetermined voltage between the article and the counter electrode opposed to the article for a predetermined time, whereby the coating agent dispersed or dissolved in the solution is electro-deposited locally on the article surface to form a coating on the selected portion of the article surface. Electrodeposition is carried out while the electrodepositing solution is circulated in such a way that it overflows the inner tank into the outer tank and is fed from the outer tank back to the inner tank by the feedback means. That is, electrodeposition is carried out while the concentration of the coating agent in the solution is kept uniform, the surface or level of the solution is kept constant at a height corresponding to the upper rim of the inner tank, and the rectifying member suppresses the surface or level of the solution from waving. Therefore, when electrodeposition is effected on the article which is partially immersed in the electrodepositing solution, the electrodepositing solution of uniform concentration having a stable and flat surface without waving is maintained at the constant level, and additionally, the immersion depth or extent of the article which is partially immersed in the electrodepositing solution is maintained in the desired range. This ensures that a uniform coating is electro-deposited onto the selected portion of the article surface. By controlling electrodepositing conditions including applied voltage, conduction time, electrodepositing solution concentration, and the shape and dimensions of the electrode, a thickness of the coating (or coating weight) may be easily and accurately adjusted.

When a rare earth permanent magnet is prepared, as set forth in Claim 10, by coating a sintered magnet body having a $R^1$—Fe—B base composition (wherein $R^1$ is at least one element selected from rare earth elements inclusive of Y and Sc) with a particle powder comprising at least one member selected from among an oxide, fluoride, oxyfluoride, hydride, and rare earth alloy of $R^2$ (wherein $R^2$ is at least one element selected from rare earth elements inclusive of Y and Sc), and heat treating the coated magnet body for causing $R^2$ to be absorbed in the magnet body, better results are obtained by using the electrodepositing apparatus defined herein, electrodepositing the powder to form a powder coating on the selected portion of the magnet body, and heat treating the coated magnet body for diffusion and absorption. That is, the amount of the powder consumed is significantly saved, and the desired rare earth element, typically Dy or Tb is effectively diffused and absorbed in the necessary portion of the magnet body. Thus a high-performance rare earth magnet having a satisfactory remanence and high coercive force can be prepared in an efficient and economical manner.

In the embodiments of Claims 2 to 8 wherein the electrodepositing solution is received in the inner tank, overflows the inner tank, and defines a surface at the upper rim of the inner tank, provisions are taken for inhibiting the electrodepositing solution from waving for thereby maintaining the solution surface flatter. Specifically, in Claim 2, the inner tank includes a peripheral wall which is provided at its upper rim with a plurality of equally spaced apart V-shaped notches. The electrodepositing solution overflows across the notches. Since the influence of surface tension is substantially eliminated, the surface of the solution is kept flatter.

As set forth in Claim 3, a return pipe having a plurality of orifices is extended through the inner tank along the bottom wall, the return pipe having a proximal end connected to the feedback means, and the electrodepositing solution flowing through the return pipe is injected into the inner tank through the orifices. The solution is circulated while the solution is introduced into the inner tank near its bottom and over a wide range. This prevents the solution surface from waving. There is a tendency that when the solution is injected through the orifices in the return pipe, the rate of injection from those orifices disposed near the distal end of the return pipe is higher. Thus, as set forth in Claim 4, the orifices are arranged in the return pipe such that their diameter may gradually or stepwise decrease from the proximal end to the distal end of the return pipe. Then the amount of the solution injected is equalized on the proximal and distal end sides. The solution is more uniformly introduced into the inner tank. This ensures to prevent the solution surface from waving.

As set forth in Claim 5, a rectifier plate having a plurality of apertures is used as the rectifying (or flow straightening) member. The rectifier plate is disposed at a vertical intermediate position in the inner tank and horizontally extended, for thereby preventing the surface of the electrodepositing solution from waving. There is a tendency that when the solution is fed into the inner tank near its bottom and overflows across the upper rim of the inner tank, the flow velocity of the solution near the peripheral wall of the inner tank is higher than near the center. Thus, as set forth in Claim 6, the diameter of apertures near the periphery is set smaller than the diameter of apertures near the center of the rectifier plate, for thereby suppressing the solution surface from waving due to the differential flow velocity.

As set forth in Claim 7, a metal plate having a plurality of apertures is used as the counter electrode. This minimizes the disturbance or turbulence of the solution surface by the presence of the counter electrode. As set forth in Claim 8, a frusto-conical shaped metal disk having a plurality of apertures is used as the counter electrode. With the influence of the counter electrode shape on an electrodeposited coating being taken into account, the counter electrode shape is optimized, for thereby minimizing coating unevenness or a variation of coating weight.

As set forth in Claim 9, means for monitoring the volume, temperature, concentration or flow rate of the electrodepositing solution is provided, allowing for stable electrolysis.

Advantageous Effects of Invention

The electrodepositing apparatus of the invention is operated by immersing a selected portion of an article in an electrodepositing solution of a coating agent and depositing the coating agent locally on the selected portion of the article via electrodeposition. Since the electrodepositing solution is circulated through the apparatus in an overflow manner, the solution is kept uniform and the surface of the overflowing solution is controlled flat during electrodeposition. Thus the depth to which the article is immersed (immersion depth) may be accurately adjusted, and the position or area of the article at which the coating agent is deposited may be accurately and easily controlled.

When a rare earth permanent magnet is prepared by coating the surface of a sintered magnet body having a $R^1$—Fe—B base composition (wherein $R^1$ is at least one element selected from rare earth elements inclusive of Y and Sc) with a powder containing an oxide, fluoride, oxyfluoride, hydride or rare earth alloy of $R^2$ (wherein $R^2$ is at least one element selected from rare earth elements inclusive of Y and Sc) and heat treating the coated magnet body, the electrodepositing apparatus of the invention is used to coat the selected portion of the magnet body with the powder locally via electrodeposition. The powder coating is formed locally (or partially) and accurately on the necessary portion of the magnet body where coercive force is especially required. This leads to a substantial saving of the amount of the powder consumed and permits a coercivity-enhancing effect to exert at the necessary portion, the effect being equivalent to that obtained from coating over the entire surface. The invention ensures to prepare a R—Fe—B base sintered magnet having a high remanence and coercive force. The amount of expensive rare earth-containing powder consumed is effectively saved without any loss of magnetic properties. Thus the preparation of R—Fe—B base sintered magnet is efficient and economical.

DESCRIPTION OF PREFERRED EMBODIMENTS

Figure 1:
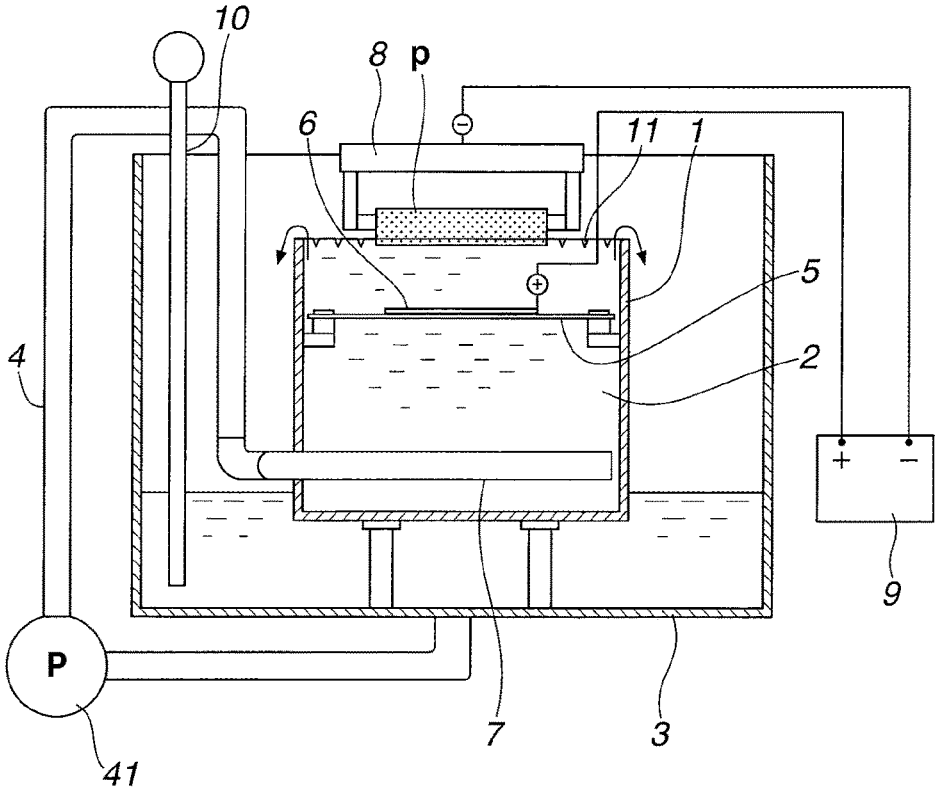
FIG. 1 schematically illustrates an electrodepositing apparatus in one embodiment of the invention.

As used herein, the terms "upper", "lower", "vertical", "horizontal" and the like are used in conjunction with the view of FIG. 1.

Briefly stated, the electrodepositing apparatus of the invention is such that an article is coated by immersing the article in an electrodepositing solution having a coating agent dispersed or dissolved in a solvent, and applying a voltage between the article and a counter electrode for letting the coating agent deposit on the surface of the article. As mentioned above, a selected portion of the article is immersed in the electrodepositing solution, and electrodeposition is carried out locally on the selected portion of the article. The local electrodeposition ensures to form a uniform coating accurately on the selected portion.

Referring to FIG. 1, the electrodepositing apparatus in one embodiment of the invention is described in detail. The apparatus includes an inner tank 1 and an outer tank 3. The inner tank 1 is a rectangular box consisting of a peripheral wall and bottom wall, which is open at the upper end. The inner tank 1 is filled with an electrodepositing solution 2. The outer tank 3 is a rectangular box consisting of a peripheral wall and bottom wall, which is open at the upper end. The outer tank 3 is larger than the inner tank 1 so that the inner tank 1 is enclosed in the outer tank 3. Thus the outer tank 3 receives the solution 2 overflowing the inner tank 1. The apparatus includes a feedback line 4 connecting a discharge port in the bottom wall of outer tank 3 to return pipes 7 which are extended through the inner tank 1 near the bottom. A pump 41 is disposed in the feedback line 4 for pumping the solution from the outer tank 3 to the bottom of the inner tank 1 through the feedback line 4. The solution 2 is circulated in this way. The feedback line 4, pump 41 and return pipes 7 constitute the feedback means. A flow meter (not shown) may be disposed in the feedback line 4 for monitoring the flow velocity of the solution 2 through the line, whereby the circulating amount or velocity of the solution may be adjusted.

Figure 2:
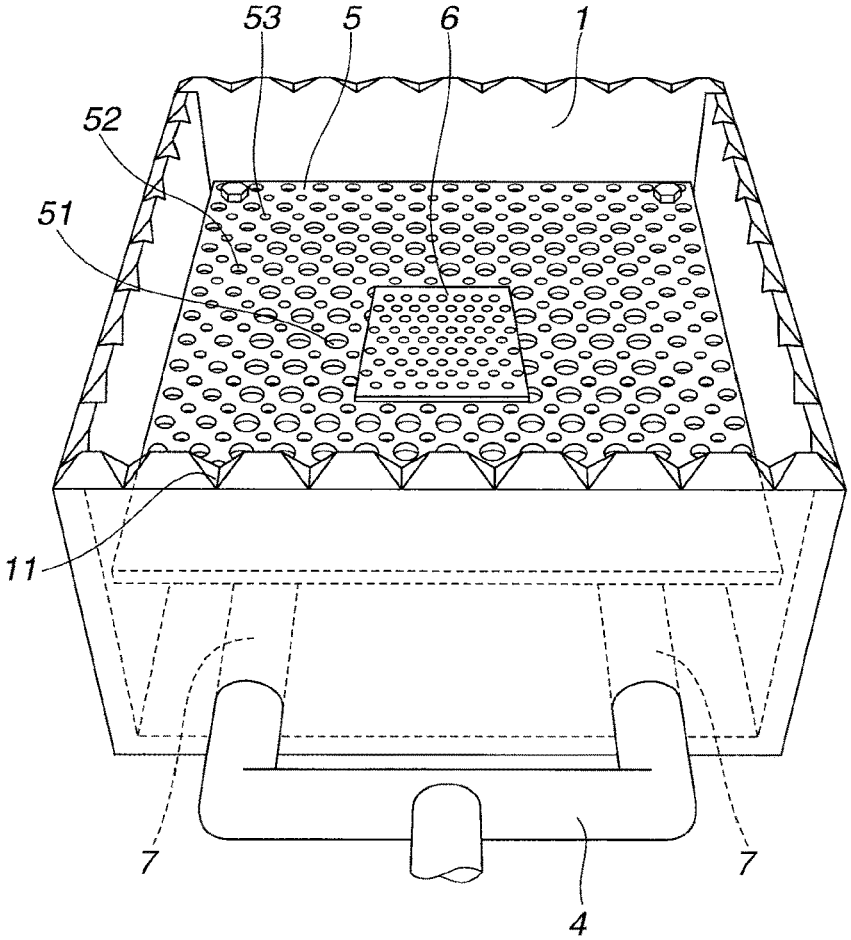
FIG. 2 is a perspective view of the inner tank in the electrodepositing apparatus.

As best shown in FIG. 2, the peripheral wall of the inner tank 1 has the upper rim which is tapered upward from the outside. That is, the peripheral wall upper rim is configured like a cutting edge. The peripheral wall upper rim is provided with a plurality of equally spaced apart V-shaped notches 11. When the solution 2 overflows the upper rim of the inner tank 1, the solution passes through the notches and discharges out equally on the four sides. The notches are effective for inhibiting the surface of the solution 2 in the inner tank from waving under the influence of surface tension so that the surface of the overflowing solution 2 may be kept flat. The depth, V angle, number, and spacing of the notches 11 may be determined as appropriate, depending on the size and shape of the upper rim, the type and flow (or circulating) velocity of the solution and the like. Preferably these parameters are empirically determined by circulating the electrodepositing solution.

In the inner tank 1, a rectifier member 5 in the form of a rectangular plate is disposed at a vertical intermediate (relatively upper) position of the tank and horizontally extended so as to divide the inner tank 1 into upper and lower compartments. As shown in FIG. 2, the rectifier plate 5 is provided with apertures of three sizes, that is, large, middle and small diameter apertures 51, 52, and 53. Specifically, small apertures 53 are uniformly distributed over the entire surface of the rectifier plate 5. Large apertures 51 and middle apertures 52 are uniformly distributed among small apertures 53. Large apertures 51 are distributed in a predetermined zone about the center of the rectifier plate 5 while middle apertures 52 are distributed in a predetermined zone near the periphery of the rectifier plate 5. The distribution of large apertures 51 in a central portion and smaller apertures 52 in a peripheral portion of the rectifier plate 5 is set for the following reason.

After the electrodepositing solution 2 is fed back to the inner tank 1 near the bottom, it flows upward and overflows the upper rim of the inner tank 1. The solution flow in the tank has a tendency that the flow velocity near the peripheral wall is higher than the flow velocity near the center. The differential flow velocity may be offset by arranging apertures in the rectifier plate 5 such that the diameter of apertures (51) near the center is larger than the diameter of apertures (52) near the periphery. This arrangement is effective for preventing the surface of the solution 2 from waving due to the differential flow velocity.

The material of which the rectifier plate 5 is made is not particularly limited and may be selected from a wide variety of materials including metals and synthetic resins. When a counter electrode is secured to the rectifier plate 5 as will be described later, the plate must be made of an insulating synthetic resin such as polyvinyl chloride. It is noted that the rectifier member is not limited to the rectifier plate 5 illustrated herein. For example, a mesh plate or expanded plate may be used, and a plurality of rectifier plates may be combined to form the rectifier member.

A counter electrode 6 in the form of a rectangular metal plate is disposed on the upper surface of the rectifier plate 5 at its center. The counter electrode 6 is also provided uniformly with a plurality of apertures so that the electrodepositing solution 2 may pass therethrough. The counter electrode 6 may be made of a conductive metal plate such as stainless steel. The shape of the counter electrode 6 may be determined, depending on the shape of the article to be treated, the portion of the article subject to electrodeposition, the state of the article during immersion, the solvent of the solution, the type of coating agent, and various electrodepositing conditions. For example, a perforated metal plate may be worked into a cylinder or rectangular box. The counter electrode may also be a perforated metal disk 61 having a central portion worked into a frusto-conical shape as shown in FIG. 3.

Figure 3:
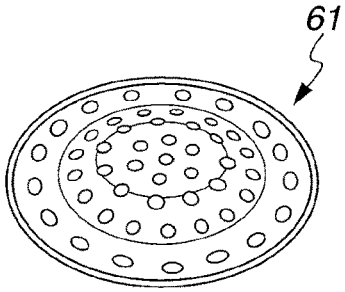
FIG. 3 is a perspective view of one exemplary counter electrode used in the electrodepositing apparatus.

The inventors have confirmed that the counter electrode 61 in the form of a perforated metal disk having a frusto-conical central portion as shown in FIG. 3 is especially effective for improving the uniformity of a coating thickness or weight. Particularly when a powder comprising an oxide of $R^2$ (wherein $R^2$ is at least one element selected from rare earth elements inclusive of Y and Sc) or the like is locally electrodeposited on the surface of a sintered magnet body of a $R^1$—Fe—B base composition (wherein $R^1$ is at least one element selected from rare earth elements inclusive of Y and Sc), the counter electrode 61 is effective for preventing a particle coating from becoming uneven or a coating weight from varying.

The size of the counter electrode 6 is not particularly limited and may be determined as appropriate. Typically the size of the counter electrode 6 is set ½ to 3 times the size of an article p to be treated. When the counter electrode is of very large size, the rectifier plate 5 may be made of a conductive metal such as stainless steel so that the rectifier plate 5 may also serve as the counter electrode. As long as the counter electrode 6 is positioned on the rectifier plate 5, the electrode 6 may be disposed contiguous to or spaced apart from the rectifier plate 5.

As shown in FIG. 2, two return pipes 7 are disposed in a lower portion of the inner tank 1 and extended through the tank along the bottom. The return pipes 7 are connected to the feedback line 4 of the feedback means. The return pipe 7 has a plurality of orifices (not shown) uniformly distributed in its tubular wall. Once the electrodepositing solution 2 is fed back to the return pipes 7, it is injected through the orifices and introduced into the inner tank 1 near the bottom. As shown in FIG. 2, the return pipes 7 are spaced apart a distance and extended parallel in the inner tank 1 along the bottom. The return pipes 7 have proximal ends which are extended outside the inner tank 1 and connected to the feedback line 4 via a manifold, and distal ends which are closed.

Though not shown, the orifices in the return pipe 7 are uniformly distributed in the lower side of the tubular wall so that the solution 2 may be injected toward the bottom of the inner tank 1. There is a tendency that the discharge amount of the solution injected through those orifices on the distal end side is larger than the discharge amount of the solution injected through those orifices on the proximal end side connected to the feedback line 4. For correcting the difference in discharge amount, the orifices are preferably arranged in the return pipe such that their diameter may gradually or stepwise decrease from the proximal end to the distal end of the return pipe. Although two return pipes 7 are shown, the number of return pipes is not critical.

In FIG. 1, the apparatus further includes a holding means in the form of a mechanical clamp 8 for holding the article p so that the article p may be partially immersed in the electrodepositing solution 2 in the inner tank 1. The mechanical clamp 8 is connected to a robot arm, for example, so that it may be moved in any directions including vertical and lateral directions. The clamp 8 tightly holds the article p in the predetermined attitude so that the article may be immersed in the solution from above, kept immersed in a stable manner, and then pulled up. The clamp 8 enables to adjust the immersion depth or extent of the article p which is partially immersed in the electrodepositing solution and the lateral position of the article p relative to the counter electrode 6. The holding means is not limited to the mechanical clamp illustrated above, as long as it holds the article p in the predetermined attitude tightly and translates the article in at least vertical direction so that the article p may be vertically moved into and out of the solution, and enables to adjust the immersion depth or extent of the article p in the solution.

Though not shown, the mechanical clamp 8 has a probe which is brought in pressure contact with the article when the clamp holds the article. Electricity is conducted from a DC power supply 9 (to be described below) to the article p via the probe. The probe or conductive means to the article may be omitted if the holding means itself provides for electric conduction to the article.

Also shown in FIG. 1 is a DC power supply 9 which is electrically connected to the counter electrode 6 and the probe of the mechanical clamp 8 for applying a predetermined voltage between the article p held by the clamp 8 and the counter electrode 6. Although FIG. 1 is illustrated with the article p made a cathode and the counter electrode 6 made an anode, the polarity of applied voltage may be set depending on the polarity of the coating agent in the electrodepositing solution.

Also shown in FIG. 1 is a level meter 10 for detecting the surface of the electrodepositing solution in the outer tank 3. The volume of the electrodepositing solution is managed by means of the level meter 10. Though not shown, a thermometer, concentration meter or another meter may be installed for monitoring the electrodepositing solution. Also if desired, there may be installed a chiller for controlling the temperature of the solution, a filter for removing foreign matter from the solution, or the like.

Now it is described how to use and operate the electrodepositing apparatus illustrated above, with reference to an example wherein a selected portion of a sintered magnet body having a $R^1$—Fe—B base composition (wherein $R^1$ is at least one element selected from rare earth elements inclusive of Y and Sc) is immersed in an electrodepositing solution of a particle powder dispersed in a solvent, the powder containing an oxide, fluoride, oxyfluoride, hydride or rare earth alloy of $R^2$ (wherein $R^2$ is at least one element selected from rare earth elements inclusive of Y and Sc), and electrodeposition is effected to deposit particles on the magnet body surface to form a powder coating on the selected portion of the magnet body.

An electrodepositing solution of the powder dispersed in a solvent is supplied to the inner and outer tanks 1 and 3. The pump 41 is actuated so that the electrodepositing solution 2 may circulate through the apparatus. The solution is pumped from the outer tank 3 to the return pipes 7 through the feedback line 4 and injected into the inner tank 1 through the orifices (not shown) in the return pipes 7. The solution flows upward in the inner tank 1, overflows the upper rim of the inner tank 1, and falls down into the outer tank 3.

The solution 2 flowing in the inner tank 1 is rectified or straightened by the rectifier plate 5, after which the solution overflows the upper rim of the inner tank 1 across the V-shaped notches 11 in the rim. The notches 11 function to minimize the influence of surface tension so that the solution 2 overflowing the inner tank 1 may keep its surface flat. Thus the solution 2 defines a substantially flat surface along the upper rim of the inner tank 1.

The substantially flat surface of the solution 2 refers to a liquid surface consisting of waves having a crest-valley height of preferably up to 3 mm, more preferably up to 1 mm, which is a mirror-like surface. Then the immersion depth or extent of the sintered magnet body (article) p can be adjusted in the millimeter order.

The circulating amount of the electrodepositing solution 2 may be determined as appropriate depending on the dimensions of the inner tank 1. For the inner tank 1 having a volume of 20 to 50 L, for example, the solution may be circulated at a flow rate of 10 to 250 L/min, preferably 20 to 100 L/min, and more preferably 30 to 60 L/min. If the circulating amount is too small, powder particles may settle down at weak flow zones in the tanks. If the circulating amount is too large, the flow volume across the upper rim of the inner tank 1 becomes large so that the solution surface may become wavy to interfere with uniform electrodeposition on the selected portion.

When the electrodepositing solution 2 is circulated by means of the pump 41, the pump 41 may be controlled by an inverter. The inverter control ensures that the pump 41 is operated for slow circulation at a flow rate of up to 30 L/min, for example, in the quiescent period, and the pump 41 is operated for proper circulation at a flow rate of 30 to 60 L/min in the electrodepositing period. Then electrodeposition can be continued while the particles are kept fully dispersed in the solution and the electric power consumed is saved.

While the electrodepositing solution 2 is circulated in this way, the mechanical clamp 8 is manipulated so as to hold the sintered magnet body (article) p and to move down the magnet body to immerse it in the solution in the inner tank 1 to a predetermined depth, thereby bringing the necessary portion of the magnet body p in contact with the solution 2. That is, the selected portion of the magnet body p is immersed in the solution to a certain depth below the surface. In the immersed state, the DC power supply 9 is actuated to apply a predetermined voltage between the magnet body p and the counter electrode 6 for a predetermined time for causing the powder (dispersed in the solution) to deposit on the immersed portion of the magnet body p to form a powder coating.

Electric conduction conditions may be determined as appropriate and are not particularly limited. Typically, a voltage of 1 to 300 volts, especially 5 to 50 volts is applied for 1 to 300 seconds, especially 5 to 60 seconds. Also the temperature of the electrodepositing solution is not particularly limited. Typically the solution is set at 10 to 40° C. Manipulation should preferably be such that the mechanical clamp 8 may not contact with the electrodepositing solution, especially during electrodepositing operation.

Although the magnet body p is made a cathode and the counter electrode 6 made an anode in the arrangement of FIG. 1, the polarity may be changed depending on the composition of the electrodepositing solution 2. In this embodiment, the electrodepositing solution is prepared by dispersing a powder containing an oxide, fluoride, oxyfluoride, hydride, or rare earth alloy of $R^2$ (wherein $R^2$ is at least one element selected from rare earth elements inclusive of Y and Sc) in water or a suitable organic solvent, and adding a surfactant and other additives, if desired. Since the polarity of the powder in the electrolytic solution changes with the presence/absence and type of the surfactant, the polarity of the magnet body p and counter electrode 6 may be set depending on these conditions.

Once electrodeposition is completed by electric conduction for the predetermined period, the magnet body p is pulled up from the solution in the inner tank 1, spun or air blown to remove extra droplets, and then dried in a suitable manner.

As described above, the electrodepositing apparatus ensures that a selected portion of a sintered magnet body (article) p is immersed in the electrodepositing solution, and electrodeposition is effected to deposit the powder locally on the necessary portion of the magnet body. During the operation, the surface of the electrodepositing solution overflowing the inner tank is kept as a substantially flat surface free of substantial waves or curves, specifically as a mirror-like surface including waves of up to 1 mm as will be demonstrated in Experiments 1 to 3. The immersion depth or extent may be adjusted in the millimeter order. Thus a satisfactory powder coating may be formed only on the necessary portion of the magnet body, and the amount of expensive powder consumed be significantly saved.

After a local powder coating is deposited on the necessary portion of the magnet body as described above, the coated magnet body is heat treated by the standard technique. This heat treatment is referred to as "absorption treatment." Through the absorption treatment, $R^2$ in the powder deposited on the magnet surface is concentrated in the rare earth-rich grain boundary component within the magnet so that $R^2$ is incorporated in a substituted manner near a surface layer of $R_2Fe_{14}B$ primary phase grains. The absorption treatment effectively increases the coercive force of the R—Fe—B sintered magnet without substantial sacrifice of remanence (or residual magnetic flux density). Since electrodeposition is carried out using the apparatus of the invention, the absorption treatment can be locally assigned to the selected area of the magnet where coercive force is required. Then, the amount of expensive powder used is effectively saved. The magnetic performance available on the necessary portion of the magnet body is comparable to that obtained from the overall coverage of a magnet body with the powder and subsequent absorption treatment. If desired, the absorption treatment may be followed by aging treatment at a temperature which is below the absorption treatment temperature.

Experiments were carried out to demonstrate the benefits of the electrodepositing apparatus of the invention.

Preparation of Sintered Magnet Body

An alloy in thin plate form was prepared by a strip casting technique, specifically by weighing Nd, Al, Fe and Cu metals having a purity of at least 99% by weight, Si having a purity of 99.99% by weight, and ferroboron, radio-frequency heating in an argon atmosphere for melting, and casting the alloy melt on a copper single roll. The alloy consisted of 14.5 atom % of Nd, 0.2 atom % of Cu, 6.2 atom % of B, 1.0 atom % of Al, 1.0 atom % of Si, and the balance of Fe. Hydrogen decrepitation was carried out by exposing the alloy to 0.11 MPa of hydrogen at room temperature to occlude hydrogen and then heating at 500° C. for partial dehydriding while evacuating to vacuum. The decrepitated alloy was cooled and sieved, yielding a coarse powder under 50 mesh.

Subsequently, the coarse powder was finely pulverized on a jet mill using high-pressure nitrogen gas into a fine powder having a mass median particle diameter of 5 μm. The fine powder was compacted in a nitrogen atmosphere under a pressure of about 1 ton/cm$^2$ while being oriented in a magnetic field of 15 kOe. The green compact was then placed in a sintering furnace with an argon atmosphere where it was sintered at 1,060° C. for 2 hours, obtaining a sintered magnet block. The magnet block was machined on all the surfaces into a block magnet body. It was cleaned in sequence with alkaline solution, deionized water, nitric acid and deionized water, and dried. There were obtained block magnet bodies of three types, magnet body A of 90 mm long×40 mm wide×22 mm thick, magnet body B of 90 mm long×35 mm wide×30 mm thick, and magnet body C of 90 mm long×40 mm wide×30 mm thick.

Preparation of Electrodepositing Solution

Terbium oxide powder having an average particle size of 0.2 μm was thoroughly mixed with deionized water at a weight fraction of 40% to form a slurry having terbium oxide particles dispersed therein. The slurry served as an electrodepositing solution.

Experiments 1 to 3

The electrodepositing solution was supplied to the electrodepositing apparatus in FIGS. 1 and 2. The solution was circulated at a flow rate of 45 L/min and kept at a temperature of 21° C. while the solution overflowed the inner tank 1 of 15 L volume. The surface of the overflowing solution was controlled as a mirror-like surface including waves with a height of up to 1 mm. The block magnet body A (depicted as article p) was held by the mechanical clamp 8, moved down in thickness direction and immersed in the solution to a depth of 2 mm from the overflow surface. The magnet body p was spaced apart 20 mm from the counter electrode 6 of stainless steel SUS304. With the counter electrode 6 made an anode and the magnet body p made a cathode, a DC voltage of 10 volts was applied for 10 seconds to effect electrodeposition. The magnet body was pulled out of the solution and immediately dried in hot air. The magnet body p was turned up-side-down. The same operations as above were repeated. In this way, a thin coating of terbium oxide was deposited only on the front and back surfaces of the magnet body p.

Electrodeposition was similarly carried out on magnet bodies B and C. For all magnet bodies A, B and C, the area density of terbium oxide deposited was 85 μg/mm$^2$ on both the front and back surfaces.

Each of the magnet bodies A, B and C having a thin coating of terbium oxide particles locally deposited thereon was subjected to absorption treatment in an argon atmosphere at 900° C. for 5 hours. It was then subjected to aging treatment at 500° C. for one hour, and quenched, obtaining a magnet body. From six areas on the surface of the magnet body, pieces of 2 mm×6.4 mm×7 mm were cut out and measured for magnetic properties. An increase of coercive force to about 660 kA/m due to the absorption treatment was confirmed, as reported in Table 1.

Comparative Experiments 1 to 3

The rectifier plate 5 was removed from the electrodepositing apparatus shown in FIGS. 1 and 2. The notches 11 in the peripheral wall upper rim of the inner tank 1 were buried to give a flat upper rim. Otherwise as in Experiments 1 to 3, the electrodepositing solution 2 was circulated through the apparatus while it overflowed the inner tank 1. The surface of the overflowing solution included waves with a height of 1 to 5 mm. As in Experiments 1 to 3, each of block magnet bodies A, B and C was partially immersed in the solution. Electrodeposition was carried out on both surfaces of the magnet body. The magnet body was covered with a thin coating of terbium oxide only on front and back surfaces. The area density of terbium oxide deposited was 85 μg/mm$^2$ on both the front and back surfaces.

Each magnet body having a thin coating of terbium oxide particles locally deposited on its surface was subjected to absorption treatment and aging treatment as in Experiments 1 to 3. Magnet pieces were similarly cut out and measured for magnetic properties. An increase of coercive force to about 660 kA/m due to the absorption treatment was confirmed, as reported in Table 1.

Reference Experiments 1 to 3

Figure 4:
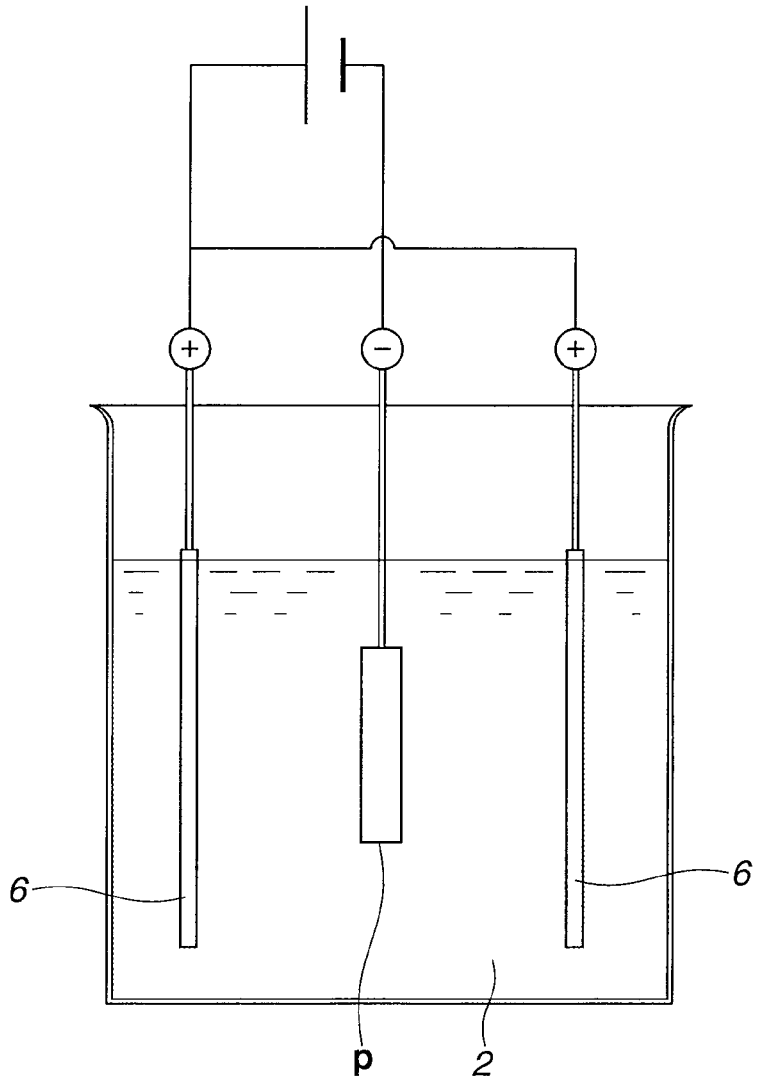
FIG. 4 schematically illustrates an electrodepositing apparatus used in Reference Experiments 1 to 3.

Electrodeposition was carried out under the same conditions as in Experiments 1 to 3 except that as shown in FIG. 4, a magnet body (depicted as article p) was longitudinally and entirely immersed in the electrodepositing solution 2 and interposed between a pair of counter electrodes 6 at a spacing of 20 mm and the solution 2 was stirred. A thin coating of terbium oxide was deposited on the entire surfaces of each of magnet bodies A, B and C. The area density of terbium oxide deposited was 85 μg/mm$^2$.

The magnet body having a thin coating of terbium oxide particles deposited on the entire surfaces (i.e., overall coverage) was subjected to absorption treatment and aging treatment as in Experiments 1 to 3. Magnet pieces were cut out of the magnet body and measured for magnetic properties. An increase of coercive force to about 660 kA/m due to the absorption treatment was confirmed.

The conditions and results of Experiments 1 to 3, Comparative Experiments 1 to 3, and Reference Experiments 1 to 3 are tabulated in Table 1. The powder consumption, which is an amount of powder deposited, is computed from a weight gain of a magnet body before and after electrodeposition. The increase of coercive force is an average of 6 magnet pieces.

TABLE 1

| | | Magnet dimensions (mm) | Depositing range | State of overflow surface | Increase of coercive force (kA/m) | Powder consumption (g/body) | Relative powder consumption* |
|---|---|---|---|---|---|---|---|
| Experiment | 1 | 90 × 40 × 22 | local | mirror-like surface with waves ≤1 mm | 660 | 0.700 | 63.75 |
| | 2 | 90 × 35 × 30 | local | mirror-like surface with waves ≤1 mm | 661 | 0.621 | 52.94 |
| | 3 | 90 × 40 × 30 | local | mirror-like surface with waves ≤1 mm | 659 | 0.700 | 54.90 |
| Comparative Experiment | 1 | 90 × 40 × 22 | local | waves of 1-5 mm | 660 | 0.778 | 70.85 |
| | 2 | 90 × 35 × 30 | local | waves of 1-5 mm | 662 | 0.698 | 59.51 |
| | 3 | 90 × 40 × 30 | local | waves of 1-5 mm | 658 | 0.786 | 61.65 |
| Reference Experiment | 1 | 90 × 40 × 22 | overall | — | 662 | 1.098 | 100 |
| | 2 | 90 × 35 × 30 | overall | — | 664 | 1.173 | 100 |
| | 3 | 90 × 40 × 30 | overall | — | 633 | 1.275 | 100 |

*Relative powder consumption is a powder consumption in Experiment relative to the powder consumption in Reference Experiment which is 100.

As seen from Table 1, the electrodepositing apparatus of the invention ensures that local (or partial) electrodeposition is carried out accurately while controlling the surface of the electrodepositing solution flat and maintaining the accurate depth of immersion. The amount of terbium oxide powder consumed is saved. The increase of coercive force is comparable to that resulting from the overall coverage.

Experiment 4

As in "Preparation of sintered magnet body" section, a block magnet body D of 85 mm long×45 mm wide×20 mm thick was obtained. Electrodeposition was carried out on magnet body D as in Experiment 1 except that a counter electrode 61 consisting of a frusto-conical center and an annular flange as shown in FIG. 3 was used instead of the counter electrode 6 in FIGS. 1 and 2. Electrodeposition was carried out using counter electrodes 61 of four types having a different set of dimensions r1, r2 and h shown in FIG. 5 (A). For all the counter electrodes 61, the flange had an outer diameter of 100 mm.

Using a fluorescent X-ray coating thickness gauge, the coating weight of particles on the coated surface (i.e., major surface of 85 mm×45 mm) of each magnet body was measured at 630 equally spaced apart points in a matrix of 18×35 points. A proportion (%) of those points having a coating weight of 90 to 120 μg/mm$^2$, within a coating weight range of 30 μg/mm$^2$, was computed. A variation of coating weight is represented by the standard deviation. The results are shown in Table 2.

Experiments 5 and 6

Figure 5A:
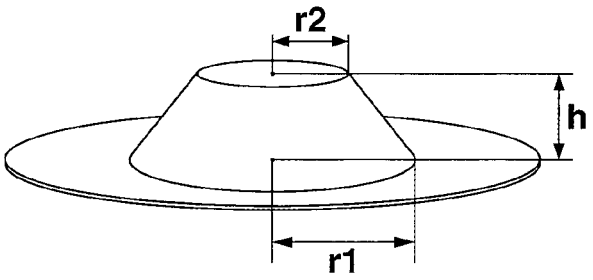
FIGS. 5 A, B and C illustrate the shape and dimensions of counter electrodes used in Experiments 4 to 6, respectively.
Figure 5B:
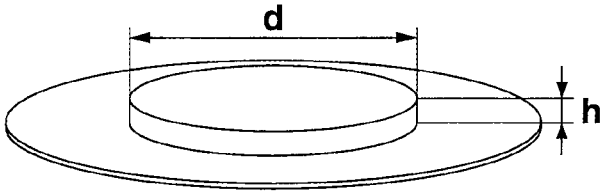
Figure 5C:
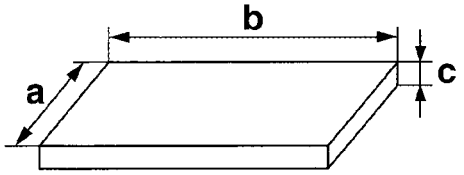

Electrodeposition was carried out as in Experiment 4, aside from using a counter electrode consisting of a central cylindrical protrusion and an annular flange as shown in FIG. 5 (B) or a counter electrode in the form of a rectangular plate as shown in FIG. 5 (C). For each case, electrodeposition was carried out using counter electrodes of three types having a different set of dimensions d and h in FIG. 5 (B) or dimensions a, b and c in FIG. 5 (C). As in Experiment 4, a proportion (%) of those points having a coating weight of 90 to 120 μg/mm$^2$, within a coating weight range of 30 μg/mm$^2$, was computed. A variation of coating weight is represented by the standard deviation. The results are shown in Table 2.

It is noted that each of the counter electrodes used in Experiments 4, 5 and 6 was made of stainless steel SUS304 and perforated with equally spaced apart apertures.

TABLE 2

| | Counter electrode | | Proportion within a coating weight | |
|---|---|---|---|---|
| | Shape | Dimensions (mm) | range of 30 μg/mm$^2$ (%) | Standard deviation |
| Experiment 4 | Frusto-conical protrusion | r1 = 20, r2 = 10, h = 5 | 83.5 | 9.6 |
| | | r1 = 30, r2 = 15, h = 5 | 98.3 | 5.2 |
| | | r1 = 4, r2 = 20, h = 5 | 97.6 | 7.1 |
| | | r1 = 40, r2 = 20, h = 10 | 95.1 | 8.2 |
| Experiment 5 | Cylindrical protrusion | d = 30, h = 2 | 26.1 | 28.8 |
| | | d = 45, h = 2 | 52.1 | 22.2 |
| | | d = 60, h = 2 | 65.7 | 18.3 |
| Experiment 6 | Rectangular plate | a = 30, b = 30, c = 2 | 34.8 | 26.7 |
| | | a = 40, b = 40, c = 2 | 56.4 | 21.4 |
| | | a = 50, b = 50, c = 2 | 70.7 | 17.6 |

As seen from Table 2, the counter electrode 61 of frusto-conical shape is effective for reducing the unevenness of powder coating (or variation of coating weight).

Japanese Patent Application No. 2014-029677 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing a rare earth permanent magnet, comprising the steps of:

coating a sintered magnet body having a $R^1$—Fe—B base composition, wherein $R^1$ is at least one element selected from Sc, Y, La, Ce, Pr, Nd, Pm, Sm, Eu, Gd, Tb, Dy, Ho, Er, Tm, Yb, and Lu, with a powder comprising at least one member selected from the group consisting of an oxide, fluoride, oxyfluoride, hydride, and rare earth alloy of $R^2$, wherein $R^2$ is at least one element selected from Sc, Y, La, Ce, Pr, Nd, Pm, Sm, Eu, Gd, Tb, Dy, Ho, Er, Tm, Yb, and Lu, and heat treating the coated magnet body for causing $R^2$ to be absorbed in the magnet body, wherein the coating step includes the steps of:

providing an electrodepositing apparatus comprising an inner tank filled with an electrodepositing solution and adapted to effect electrodeposition on an article immersed in the solution, wherein a peripheral wall of the inner tank is provided, at an upper edge of the peripheral wall, with a plurality of equally spaced apart V-shaped notches across which the electrodepositing solution overflows, an outer tank enclosing the inner tank so that the outer tank receives an overflow of the electrodepositing solution from the inner tank, a feedback system comprising a flow-out pipe extending from the outer tank and a return pipe extending back to the inner tank near the bottom of the inner tank, a rectifying plate disposed at a vertical intermediate position in the inner tank and horizontally extended so as to divide the inner tank into upper and lower compartments, the rectifying plate having a plurality of first apertures distributed so that the rectifying plate rectifies flow of the electrodepositing solution and suppresses waves in the surface of the electrodepositing solution overflowing from the upper rim of the inner tank, an article holder configured to hold the article so that the article is partially immersed in the electrodepositing solution in the inner tank, a counter electrode, with a plurality of second apertures, disposed in the inner tank and opposed to the article which is to be held by the article holder and immersed in the electrodepositing solution, and a power supply for applying a predetermined voltage between the article and the counter electrode, circulating the electrodepositing solution in such a way that it overflows the inner tank into the outer tank and is fed back from the outer tank to the inner tank near its bottom by the feedback system, immersing a selected portion of the magnet body in the electrodepositing solution in the inner tank, the electrodepositing solution comprising a solvent and the powder dispersed in the solvent, and electrodepositing the powder on the surface of the magnet body to form a powder coating on the selected portion of the magnet body by actuating the power supply to apply the predetermined voltage between the article and the counter electrode.

2. The method of claim 1, wherein the inner tank includes a bottom wall, the return pipe having a plurality of orifices in its tubular wall, the return pipe being connected to the feedback system and extended through the inner tank along the bottom wall, and the feedback system feeds the electrodepositing solution into the return pipe to inject the electrodepositing solution into the inner tank through the orifices.

3. The method of claim 2, wherein the orifices are arranged in the return pipe such that their diameter gradually or stepwise decreases from the proximal end to the distal end of the return pipe.

4. The method of claim 1, wherein the counter electrode is a metal plate and disposed on the rectifying plate.

5. The method of claim 4 wherein the counter electrode is a metal disk, the disk being generally frusto-conical shaped at a central portion or over its entirety.

6. The method of claim 1, further comprising at least one of a level meter, thermometer, concentration meter, and flow meter.

* * * * *